US006594931B1

(12) United States Patent
Barton et al.

(10) Patent No.: US 6,594,931 B1
(45) Date of Patent: Jul. 22, 2003

(54) FLUORESCENT ILLUMINATED SIGN ASSEMBLY

(76) Inventors: Jeffrey C. Barton, 1136 Fletcher St., Dallas, TX (US) 75223; Hans M Deitrich, 140 Maywood Cir., Coppell, TX (US) 75019

( * ) Notice: Subject to any disclaimer, the term of this patent is extended or adjusted under 35 U.S.C. 154(b) by 0 days.

(21) Appl. No.: 09/643,003

(22) Filed: Aug. 21, 2000

Related U.S. Application Data

(60) Provisional application No. 60/149,793, filed on Aug. 19, 1999.

(51) Int. Cl.[7] ..... G09F 13/00; G09F 13/04

(52) U.S. Cl. ..... 40/552; 40/564

(58) Field of Search ..... 40/550, 551, 552, 40/564; 362/812

(56) References Cited

U.S. PATENT DOCUMENTS

| | | | | | |
|---|---|---|---|---|---|
| 948,557 | A | * | 2/1910 | Wiley et al. | 40/552 |
| 3,566,525 | A | * | 3/1971 | Nassil et al. | 40/552 |
| 3,721,846 | A | | 3/1973 | Cohen | 313/15 |
| 3,746,914 | A | | 7/1973 | Olson et al. | 315/47 |
| 3,921,032 | A | | 11/1975 | Hallay | 315/106 |
| 3,965,597 | A | * | 6/1976 | Noellert | 40/551 X |
| 4,029,989 | A | | 6/1977 | Fellows | 315/51 |
| 4,074,163 | A | | 2/1978 | van der Leeuw | 313/13 |
| 4,147,947 | A | | 4/1979 | Hoeh | 313/27 |
| 4,449,071 | A | | 5/1984 | Yokayama | 315/53 |
| 4,633,135 | A | | 12/1986 | Akins | 313/594 |
| 4,701,991 | A | * | 10/1987 | Scheffer, Sr. | 29/450 |
| 4,801,840 | A | | 1/1989 | Dobrusskin et al. | 313/44 |
| 4,933,814 | A | | 6/1990 | Sanai | 342/26 |
| 5,081,395 | A | | 1/1992 | Kikuchi et al. | 313/594 |
| 5,197,798 | A | | 3/1993 | Tickner | 362/235 |
| 5,377,086 | A | | 12/1994 | Tickner | 362/235 |
| 5,379,540 | A | * | 1/1995 | Howard | 40/558 |
| 5,426,879 | A | * | 6/1995 | Hecker | 40/564 X |
| 5,475,576 | A | | 12/1995 | Daniels | 362/222 |
| 5,523,930 | A | * | 6/1996 | Fritts | 362/223 |
| 5,523,931 | A | | 6/1996 | Kassay et al. | 362/235 |
| 5,528,473 | A | | 6/1996 | Kassay et al. | 362/247 |
| 5,569,981 | A | * | 10/1996 | Cho | 315/56 |
| 5,570,525 | A | | 11/1996 | Paglieri et al. | 40/564 |
| 6,079,844 | A | * | 6/2000 | Whitehead et al. | 362/97 |
| 6,202,333 | B1 | * | 3/2001 | Grate et al. | 40/552 X |

FOREIGN PATENT DOCUMENTS

| | | | | |
|---|---|---|---|---|
| EP | 331224 | * | 9/1989 | 40/551 |

* cited by examiner

*Primary Examiner*—Brian K. Green
(74) *Attorney, Agent, or Firm*—Conley Rose, P.C.; Gene C. Vallow

(57) ABSTRACT

The present device relates to an apparatus and system used in lighting or illuminating signs, logos or sidewall letters using fluorescent lights or lamps, alone or in combination with reflective coating which can be applied to the sign interior, and reflective surfaces added in the sign interior, to deflect, disperse, reflect and direct the light emitted form the fluorescent lamps to a sign front. The apparatus and system comprises a back panel having sidewalls proximate the perimeter of the back panel and which extend upwardly to form a light channel. Sockets for receiving fluorescent lamps and their corresponding ballasts are mounted separately to the back panel such that the distance between the fluorescent lamps and the top of the light channel is maximized and the distance between the socket and the back panel is minimized. The distribution, number and relative position of the sockets and corresponding ballasts on the back panel can be adjusted to achieve the desired light illumination. For example the ballasts can be placed behind the socket receiving end to reduce the shadow caused by the ballasts. In addition, light reflective surfaces or baffles can be added to the light channel to reduce the number of fluorescent lamps.

12 Claims, 2 Drawing Sheets

FLUORESCENT ILLUMINATED SIGN ASSEMBLY

This application claims priority from U.S. Provisional Application Serial No. 60/149,793 filed on Aug. 19, 1999. Applicants are Jeffrey Conrad Barton of Dallas, Tex. and Hans Manfred Dietrich of Coppell, Tex.

FIELD OF THE INVENTION

The present invention relates to lighted or illuminated signage. More particularly, the invention relates to an apparatus and system used in lighting or illuminating signs, logos or channel letters using fluorescent lights or lamps, alone or in combination with reflective coating which can be applied to the sign interior, and reflective surfaces added in the sign interior, to deflect, disperse, reflect and direct the light emitted from the fluorescent lamps to a sign front.

BACKGROUND OF THE INVENTION

To increase visibility and for enhanced marketing, it is generally desirable to illuminate commercial and other signage. Illumination from within the sign itself has traditionally been accomplished with neon, argon, or other gaseous tube lamps. Gaseous tube lamps are often preferred because they can be shaped or conformed to the design of the sign, letter or display to provide a consistent and generally uniform illumination of the sign. Using gaseous tube lamps does, however, have certain drawbacks. In particular, they require custom shaping of the tubes by a glass craftsman to conform to the shape of the sign. They typically operate at a higher voltage causing increased operating costs and increasing the danger associated with repairs. The gaseous tube lamps are fragile and many times break in transit, during installation and use, thus requiring frequent replacement. Additionally, any required repairs are generally difficult, time consuming and costly, often requiring two trips by a repair service: one trip to remove the defunct lamp and a second trip to install a new lamp which has been custom shaped using the old lamp or measurements from the sign. Further, gaseous tube lamps fail over the entire length of the tube, thus often rendering all or a large part of the sign unlighted until the defunct tube can be replaced. Thus, neon, argon or other gaseous tube lamps are relatively expensive in terms of purchase costs, operating costs and maintenance/repair costs.

Many of the difficulties associated with gaseous tube lamps could be avoided by using fluorescent lamps to illuminate signs. Fluorescent lamps are brighter than neon, relatively maintenance free and more cost effective to maintain. When a fluorescent lamp or ballast fail, only that portion of the sign is affected. Repair is relatively simple by changing the defunct failed lamp or ballast. Further, fluorescent lamps rarely break in transit and if broken, can easily be replaced with off the shelf components.

The difficulty in using fluorescent lamps, however, is that they provide a point source of light. As a result, fluorescent lamps have a tendency to create hot spots where the lighting appears brighter near the fluorescent lamp and darker further from the fluorescent lamp. Generally, these hot spots are undesirable because the sign is not illuminated uniformly and appears patchy or blotchy. Although use of fluorescent lighting in signage has been attempted, an effective solution has not been developed which provides comparable uniformity to signs illuminated with gaseous tube lamps.

As disclosed in U.S. Pat. No. 5,475,576 to Daniels, a fluorescent light unit is provided for a sign interior. The unit includes a socket and a corresponding ballast which are mounted to a backplate in a top to bottom relationship such that a fluorescent tube extends perpendicularly away from the backplate. The unit is positioned on a back of a sign interior with the ballast underneath the socket and the fluorescent lamp extending parallel to the back sign interior. In this configuration, the ballast underneath the socket positions the fluorescent lamp closer to the sign front and further from the back of the sign interior.

As disclosed in U.S. Pat. No. 5,570,525 to Paglieri et al., a flexible sign facing with spaced point sources of illumination is described. A reflector is provided between each pair of adjacent point sources. Each reflector is shaped to reflect the light from the adjacent light source toward the front of the sign, thereby illuminating the areas of the sign facing farthest from the light sources.

In addition, U.S. Pat. No. 5,377,086 to Tickner discloses a lighting unit using multiple compact fluorescent bulbs positioned to follow the outwardly-flared inside surface of a reflector. The reflector allows the light from the compact fluorescent bulbs to be focused in the desired direction. Finally, U.S. Pat. No. 4,933,814 to Sanai discloses a planar luminescent device which incorporates light sources within reflective frames. The reflective frames include a raised portion between light sources to direct the light emitted from the light sources.

None of these references, however, have effectively resolved the problems with using fluorescent illumination in signage. This failure is evidenced by the continuing prevalence of gaseous tube lamps in the marketplace of illuminated signage as compared to the relatively paltry use of fluorescent lamps.

Through significant time and effort, it has been found that the deficiencies of fluorescent lighting can be overcome by careful positioning of the fluorescent lamps within the signage and the addition of particular surfaces and structure to the interior of the sign to enhance reflectivity. In particular, it has been learned that positioning the lamps further from the front of the sign helps to reduce the hot spots, thus providing a more even and consistent illumination throughout the sign. Additionally, minimizing the distance between the back of the sign and the fluorescent lamps allows more light to be reflected from the back of the sign, further reducing hot spots. And finally, providing additional surfaces and structures within the sign for reflecting the light emitted from the lamps creates tremendous advantages.

These findings have allowed use of fluorescent lighting in signage to provide the quality of illumination equivalent to, if not superior to, gaseous tube lamps. In addition, the apparatus and systems described herein have also allowed for a fewer number of fluorescent lamps to be used per sign, which obviously lowers the initial cost, the energy requirements and hence operating costs, and the repair costs associated with the illuminated sign.

SUMMARY OF THE INVENTION

In accordance with the present invention, there is provided a novel apparatus and system for efficiently and effectively lighting or illuminating signs, channel letters and displays using compact fluorescent lamps. The novel apparatus and system of the present invention provide a more intense and uniform illumination by increasing the distance between the fluorescent light and the front of signage. In addition, reflective material is applied to the interior of the sign to further enhance the illumination from the fluorescent lamps. Further, additional surfaces can be added to the light interior to deflect, disperse, reflect and direct the light emitted from the fluorescent lamps to the sign front. These surfaces can also be coated with a reflective material to increase the effectiveness of the fluorescent lamps in illuminating the signage.

The apparatus and system used in the present invention comprise a back panel and sidewalls proximate the perimeter of, and extending upwardly from, the back panel. The back panel and sidewalls form a light channel for a sign, letter, display or other signage to be illuminated. A plurality of ballasts connectable to an electrical power source and corresponding sockets for receiving fluorescent lamps are separately coupled to the back surface proximate the light channel. This configuration maximizes the distance between the fluorescent lamps and the top of the light channel to provide more area for the light to be deflected, disperse, reflected and directed to a sign front. In addition, the distance between the fluorescent lamps and the back panel is minimized so that the area of the back panel proximate the fluorescent lamp can effectively reflect more light for dispersing, reflecting and directing to the sign front.

The relative position of the socket and corresponding ballast can be adjusted as desired to provide a more consistent and even illumination of a sign. The ballast can be mounted on the back panel behind the portion of the fluorescent lamp which is received into the socket to minimize the shadow caused by the ballast. In addition, the number and distribution of ballasts and corresponding sockets in the light channel can be adjusted to provide the desired amount and intensity of light for the signage.

Light reflective material can be used to coat the back panel and sidewalls proximate the light channel. The reflective material helps to disperse and scatter the light emitted from the fluorescent lamps to reduce hot spots thereby providing for more consistent illumination. In addition, the reflective material helps to reflect and direct a significant amount of the light emitted from the fluorescent lamps to the sign front to illuminate the signage with maximum intensity, thereby reducing the number of fluorescent lights required to provide effective illumination of the signage.

Additional surfaces or baffles can be mounted to the back panel among and between the fluorescent lamps to provide additional surfaces for deflecting, dispersing, reflecting and directing the light emitted from the lamps. While the baffles can be of varying shapes, in one embodiment, a corresponding pair of baffles are angled by affixing their opposite ends to the sidewalls thereby narrowing the light channel proximate the back panel. In an alternative embodiment, an intermediate baffle can be coupled to the back panel between the corresponding pair of baffles to form two light channels with the pair of baffles. The intermediate baffle can be a pyramid or spherical shape, forming various angles with the back panel to which is it mounted. To improve performance, the baffles can also be coated with a reflective material. The ballasts can be mounted to the back panel proximate the sidewalls and outside the light channel formed by the angled baffles, or to the portion of the back panel under the intermediate baffle, to eliminate the shadow caused by the ballasts.

The invention is more particularly shown and described in the accompanying drawings and materials included herein.

BRIEF DESCRIPTION OF THE DRAWINGS

For a more complete understanding of the present invention, and for further details and advantages thereof, reference is now made to the following Detailed Description of the Drawings taken in conjunction with the accompanying drawings, in which.

DETAILED DESCRIPTION OF THE DRAWINGS

Figure 1:
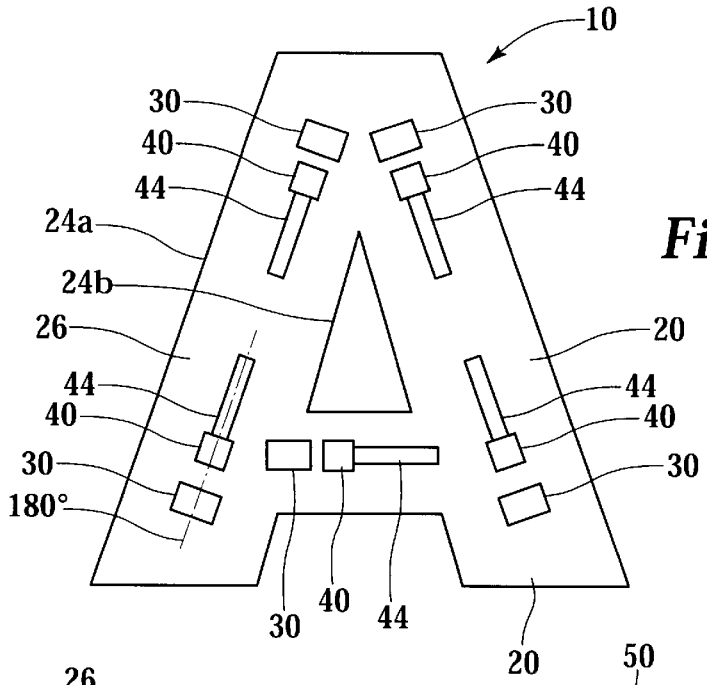
FIG. 1 provides a top view of a fluorescent illuminated sign assembly.
Figure 2:
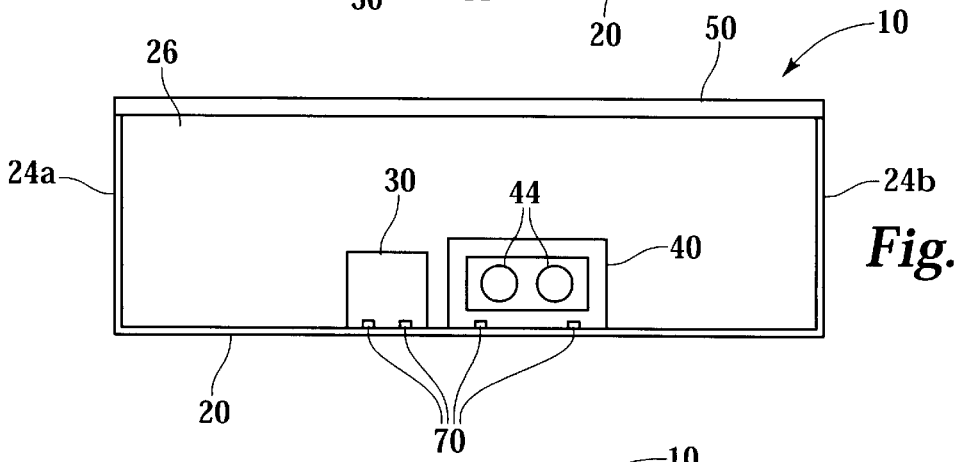
FIG. 2 provides a side view of the fluorescent illuminated sign assembly of FIG. 1.

REFERRING TO FIGS. 1 and 2, a fluorescent illuminated channel-letter sign assembly 10 as contemplated by the present invention is shown. Although a channel-letter sign is shown, the invention can similarly be applied to any sign, logo or other display to be illuminated. The assembly 10 includes a back panel 20, channels 24*a*, 24*b*, a ballast 30 and a socket 40 for receiving a fluorescent lamp 44. Channels 24*a*, 24*b* are proximate the perimeter of back panel 20 and extend outwardly from back panel 20 to form light interior 26. The channels 24*a*, 24*b* may extend outwardly from back panel 20 at any desirable angle and height. However, customer needs and desires, as well as building codes and landlord requirements, many times dictate limits to the overall size of the sign to be illuminated. Accordingly, the channels 24*a*, 24*b* may extend substantially perpendicular to and outwardly from back panel 20 to form a light interior 26 having any height, but typically the height of light interior 26 is in the range of approximately 3 inches to 10 inches. For channel-letter signs a height of approximately 5 to 6 inches is the most popular size.

A sign or letter front 50 is shaped to correspond to the perimeter of back panel 20 such that it can be mounted to channels 24*a*, 24*b* opposite from and substantially parallel to back panel 20. The letter front 50 is typically made of a translucent material so that it can be illuminated from behind by the light interior 26.

A ballast 30 having means for connecting to an electric power source is mounted to back panel 20 within the light interior 26. A socket 40 for receiving a fluorescent lamp 44 is mounted to back panel 20 separately from the corresponding ballast 30. For an elongated fluorescent lamp 44 as shown, the socket 40 is typically mounted so the lamp 44 extends substantially parallel to back panel 20. Mounting the socket 40 to back panel 20 separately from ballast 30 not only increases the distance between fluorescent lamp 44 and a sign front 50, but it also decreases the distance between fluorescent lamp 44 and back panel 20. It has been found that larger distances between fluorescent lamp 44 and a sign front 50 provide more area for the light to be deflected, dispersed, reflected and directed to the sign front 50, thereby minimizing the undesirable hot spots which are inherent to a point-source light such as the fluorescent lamp 44. It has also been found that positioning fluorescent lamp 44 closer to back panel 20 allows more light to be reflected from back panel 20 for dispersing, reflecting and directing to a sign front 50. The resulting increase in the amount of reflected light helps to further reduce hot spots and provide uniform illumination.

Mounting socket 40 and corresponding ballast 30 separately to back panel 20 can be accomplished by screws, tack, rivets or other mechanical apparatus 70. Alternatively, an thermal-resistant adhesive may be suitable. It will be understood by one skilled in the art that many other means for mounting socket 40 and corresponding ballast 30 to back panel 20 are available. For example, a bracket affixed to socket 40 may be suitable for mounting to back panel 20 so long as the bracket does not substantially increase the distance between socket 40 and back panel 20, or correspondingly decrease the distance between the socket 40 and the front panel 50. In one embodiment, the bracket increases the distance by less than 1 inch. In another embodiment of the present invention, a bracket was used which increased the distance between socket 40 and back panel 20 by less than ½ inch. In yet another embodiment, the bracket increases the distance by ¼ inch or less. In a further embodiment, the bracket increases the distance between socket 40 and back panel 20 by ½ inch or less.

Fluorescent lamp 44 is commercially available in standard sizes of 7 W, 9 W and 13 W (W=watts). Socket 40 and ballast 30 are also commercially available. The standard height of socket 40 for a standard fluorescent lamp 44 is in the approximate range of ¾ inch to 1 ¼ inch. A typical fluorescent lamp 44 includes two light tubes which are connected at their receiving end into socket 40. Each of the light tubes is about ½ inch in diameter. The extension of fluorescent lamp 44 from the receiving end of socket 40 varies depending on its standard size. A 7 W fluorescent lamp 44 extends approximately 4 inches, while a 9 W fluorescent lamp extends approximately 4 ½ inches and a 13 W fluorescent lamp extends approximately 5 inches from the receiving end of socket 40. It is to be understood that the foregoing standard commercially available specifications are provided by way of explanation and not to limit the scope of the present invention. Other fluorescent lamps, sockets and ballasts of varying shapes and sizes may be suitable to practice the present invention.

Accordingly, in a light interior 26 which is less than 6 inches in height, in one embodiment the distance between fluorescent lamp 44 and a sign front 50 is approximately 4 inches or greater. In another embodiment of a light interior 26 less than 6 inches in height, the distance between fluorescent lamp 44 and a sign front 50 is approximately 4 ½ inches or greater. In yet another embodiment of a light interior 26 less than 6 inches in height, the distance between fluorescent lamp 44 and a sign front 50 is approximately 5 inches or greater. In a further embodiment of a light interior 26 which is less than 6 inches in height, the distance between fluorescent lamp 44 and a sign front 50 is approximately 5 ¼ inches.

In a light interior 26 which is 5 ½ inches or less in height, in one embodiment, the distance between fluorescent lamp 44 and a sign front 50 is greater than 3 ½ inches. In another embodiment of a light interior 26 which is 5 ½ inches less in height, the distance between fluorescent lamp 44 and a sign front 50 is approximately 4 inches or greater. In yet another embodiment of a light interior 26 which is 5 ½ inches or less in height, the distance between fluorescent lamp 44 and a sign front 50 is approximately 4 ½ inches or greater. In a further embodiment of a light interior 26 which is 5 ½ inches or less in height, the distance between fluorescent lamp 44 and a sign front 50 is approximately 4 ¾ inches.

In a light interior 26 which is 5 inches or less in height, the distance between fluorescent lamp 44 and a sign front 50 is greater than 3 inches. In another embodiment of a light interior 26 which is 5 inches or less in height, the distance between fluorescent lamp 44 and a sign front 50 is approximately 3 ½ inches or greater. In yet another embodiment of a light interior 26 which is 5 inches or less in height, the distance between fluorescent lamp 44 and a sign front 50 is approximately 4 inches or greater. In a further embodiment of a light interior 26 which is 5 inches or less in height, the distance between fluorescent lamp 44 and a sign front 50 is approximately 4 ¼ inches.

For light interiors 26 having a height of 6 inches or greater, in one embodiment, the distance between fluorescent lamp 44 and a sign front 50 is greater than 4 inches, and the height 42 of socket 40 from back panel 20 is less than 2 inches. In another embodiment of a light interior 26 which is approximately 6 inches to 7 inches in height, the distance between fluorescent lamp 44 and a sign front 50 is approximately 4.5 inches or greater, and the height 42 of socket 40 from back panel 20 is 1.5 inches or less. In yet another embodiment of a light interior 26 having a height of approximately 6 inches to 7 inches, the distance between fluorescent lamp 44 and a sign front 50 is approximately 5 inches or greater, and the height 42 of socket 40 from back panel 20 is approximately 1 inch or less. In a further embodiment of a light interior 26 having a height in the approximate range of 6 inches to 7 inches, the distance between fluorescent lamp 44 and a sign front 50 is approximately 5 ¼ inches and the height 42 of socket 40 from back panel 20 is approximately ¾ inch.

Figure 3:
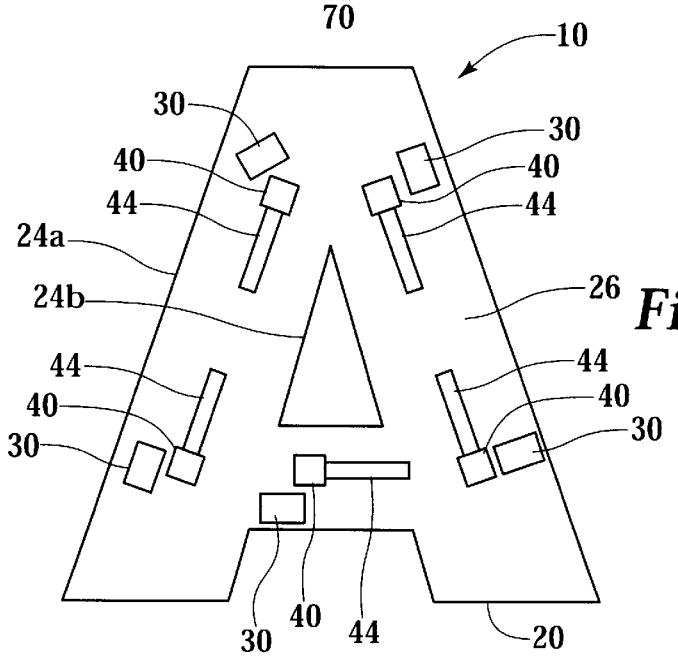
FIG. 3 provides a top view of another embodiment of a fluorescent illuminated sign assembly.

REFERRING TO FIG. 3, the relative position of socket 40 and corresponding ballast 30 on the back panel 20 can be adjusted as desired to provide a more consistent and even illumination of a sign front 50. For example, ballast 30 can be mounted on back panel 20 behind the portion of fluorescent lamp 44 where it is received into socket 40 so as to reduce the shadow which ballast 30 may cause by blocking the light emitted from fluorescent tube 44. Alternatively, ballast 30 is mounted directly behind socket 40 such that fluorescent lamp 44 extends away from ballast 30 in approximately a 180 degree line, as illustrated in FIG. 1. Mounting ballast 30 directly behind socket 40 minimizes the shadow which ballast 30 may cause by blocking the light emitted from fluorescent lamp 44. This positioning of the ballast 30 leaves the portion of back panel 20 proximate fluorescent lamp 44 relatively uninhibited in deflecting, dispersing, reflecting and directing the light emitted from fluorescent lamp 44 toward sign front 50.

The number and distribution of ballasts 30 and corresponding sockets 40 on back panel 20 can be adjusted to provide the desired amount and intensity of light for the signage. Generally, one fluorescent lamp 44 per a 12 inch by 12 inch area of back panel 20 will provide sufficient illumination. It may be desirable, however, when using a standard 7 W fluorescent lamp 44 to reduce the coverage of back panel 20 to an area of 6 by 8 inches. A 9 W fluorescent lamp 44 may cover a 7 by 8 inch area of back panel 20, while a 13 W fluorescent lamp 44 may cover an 8 by 8 inch area. It is to be understood that other factors may increase or decrease the number of fluorescent lamps 44 required to evenly and consistently illuminate a sign front. For example, a curved letter or sign may require additional fluorescent lamps 44 to be distributed along the curves to ensure that it is adequately illuminated. Other unusual shapes or eccentric signs may also require additional fluorescent lamps 44.

Figure 4:
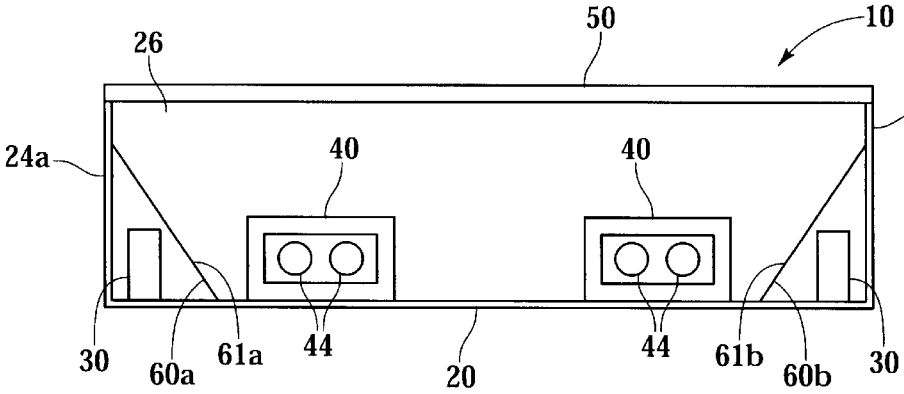
FIG. 4 provides a side view of another embodiment of a fluorescent illuminated sign assembly.
Figure 5:
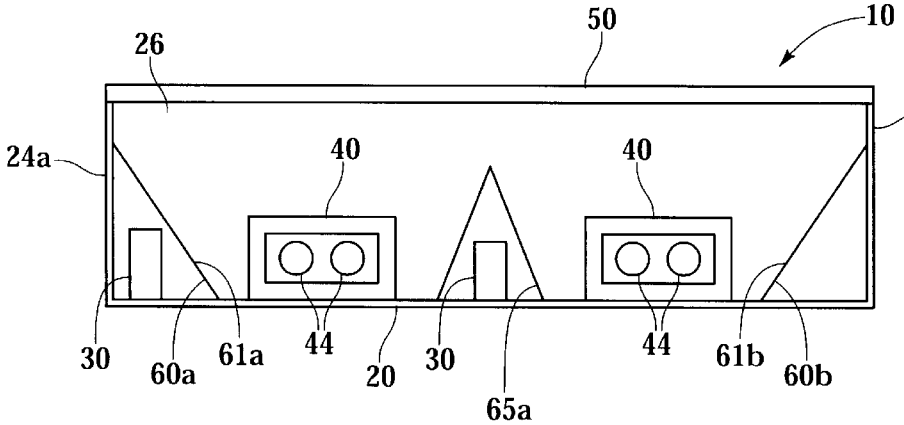
FIG. 5 provides a side view of another embodiment of a fluorescent illuminated sign assembly.
Figure 6:
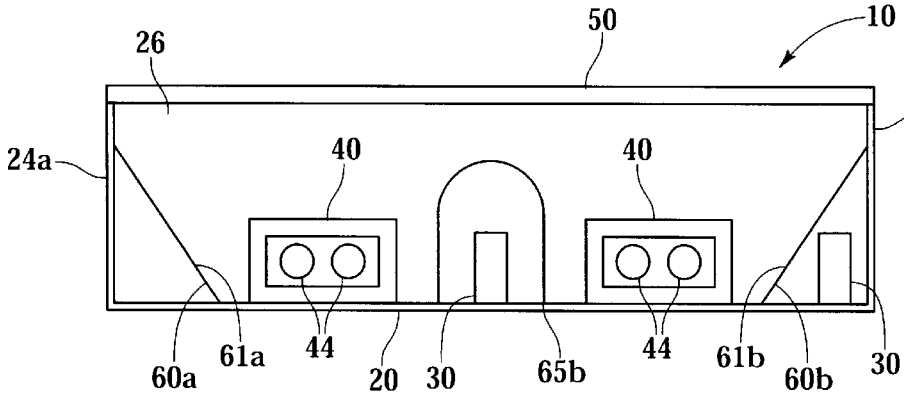
FIG. 6 provides a side view of another embodiment of a fluorescent illuminated sign assembly.

REFERRING TO FIGS. 4, 5 and 6, to minimize the number of fluorescent lamps 44 required to effectively illuminate a sign front 50, it has been found that one or more baffles 60, 65 positioned in light interior 26 provides additional surfaces for deflecting, dispersing, reflecting and directing the light emitted from the lamps, as well as filling in voids in open areas of back panel 20. In one embodiment, a corresponding pair of baffles 60*a*, 60*b* having front surfaces 61*a*, 61*b*, are each mounted at opposites ends to back panel 20 and to channels 24*a*, 24*b*, respectively, with front surfaces 61*a*, 61*b* angled toward a sign front 50. Light interior 26 is thus defined to include the area of back panel 20 between the baffle front surfaces 61*a*, 61*b*. The relative position of the ends of baffles 60*a*, 60*b* on back panel 20 and channels 24*a*, 24*b* can be adjusted to vary the angle to which front baffles surfaces 61*a*, 61*b* face toward a sign front 50 in an effort to increase the effective illumination of the sign front 50. In another embodiment, an intermediate baffle 65 is mounted on back panel 20 proximate the area within light interior 26. Intermediate baffle 65 can have any number of angled and rounded surfaces for deflecting, dispersing, reflecting and directing the light emitted from fluorescent lamp 44 to a sign front 50. By way of example and not limitation, intermediate baffle 65 can have a pyramid shape 65*a* or a rounded shape 65*b*.

Intermediate baffle 65 can also be used to reduce the area of back panel 20 and thus reduce the number of fluorescent lamps 44 required for effective illumination. For example, mounting an appropriately sized intermediate baffle 65 on a back panel 20 between baffles 60*a*, 60*b* could reduce the width of back panel 20 within light interior 26, thus requiring fewer fluorescent lamps 44.

The baffles 60*a*, 60*b* also provide an opportunity to further reduce the shadowing caused by ballasts 30. In particular, the ballasts 30 can be mounted to the area of back panel 20 which is outside the light interior 26 and behind baffles 60*a*, 60*b*. Additionally, ballasts 30 can be mounted to the area of back panel 20 which is beneath intermediate baffle 65.

Reflective material can be used to improve the performance of the surfaces within light interior 26 to more effectively illuminate a sign front 50. It has been found that surfaces , coated with material having a reflectance value of greater than 86 percent significantly enhances the ability of the surface to reflect, deflect, disperse and direct light from a fluorescent lamp 44 to provide even, consistent and brighter illumination of a sign front 50. Preferably, the reflectance value is greater than 90 percent. More preferably, the material has a reflectance value of 95 percent or higher. Even more preferably, the reflectance value of the material is 98 percent or greater. Suitable materials for coating the surfaces include reflective films such as the commercially available Light Enhancing Film developed by 3M which has a published reflectance value of 95 percent. Other suitable materials include the commercially available Star-Brite White reflective coating developed by Spraylat Sign Coatings. The Star-Brite White coating has a published reflectance value of 98 percent. The reflective materials can be applied to all interior surfaces in the light interior 26 including the back panel 20, sidewalls 24*a*, 24*b*, baffle surfaces 61*a*, 61*b* and intermediate baffle 65.

What is claimed is:

1. A channel sign assembly having relatively uniform fluorescent illumination to the human eye, comprising:

a back panel;

a plurality of side walls coupled to said back panel and extending substantially upwardly from the back panel to form a channel;

a compact fluorescent lamp mounted within said channel proximate said back panel;

a baffle directly attached to said back panel and at least one of said side walls, said baffle angled to reflect light from said lamp away from said back panel, said baffle effectively reducing a surface area of said back panel exposed to light from said lamp;

said side walls, said baffle, and the exposed surface area of said back panel defining a light channel; and a ballast for powering the lamp positioned within said channel but outside said light channel.

2. The assembly of claim 1 wherein said baffle has a first edge coupled to said back panel and a second edge coupled to said side wall.

3. The assembly of claim 1 wherein said baffle extends along the side wall and back panel thereby substantially reducing the surface area of said back panel exposed to light from said lamp such that a significant portion of the light channel is angled to reflect light from the lamp away from the back panel.

4. The assembly of claim 1 wherein said baffle is positioned at an angle of about 45 degrees relative to said back panel.

5. The assembly of claim 1 further comprising two baffles, each positioned on generally opposite sides of said lamp, and each baffle having a first edge coupled to the back panel and a second edge coupled to a side wall and angled to reflect light from the lamp away from said back panel.

6. The assembly of claim 1 further comprising a highly reflective surface substantially covering the interior surfaces of said light channel.

7. The assembly of claim 1 wherein said light channel is substantially covered with a reflective material having a reflectance value of 85% or greater.

8. The assembly of claim 1 wherein said channel has a depth of more than 4 ½ inches and said compact fluorescent lamp is 1 ½ inches or less from said back panel.

9. The assembly of claim 1 further comprising two compact fluorescent lamps mounted within said channel proximate to said back panel, said lamps linearly spaced along said channel such that there is only one lamp in each cross section of the channel taken in the shortest direction across the channel.

10. The assembly of claim 1 comprising a plurality of elongated compact fluorescent lamps mounted within said channel proximate to said back panel, said lamps positioned such that the longest longitudinal axis of the lamps is substantially aligned with said channel and substantially parallel with the back panel.

11. The assembly of claim 1 further comprising two compact fluorescent lamps mounted within said channel proximate to said back panel, and an intermediate baffle positioned proximate said back panel between said two compact fluorescent lamps and angled to reflect light from the lamps away from said back panel.

12. The assembly of claim 1 wherein said channel forms an alphanumeric character such that the assembly would generally be known as a channel letter sign.

* * * * *